US005939837A

United States Patent [19]

Canova

[11] Patent Number: 5,939,837

[45] Date of Patent: Aug. 17, 1999

[54] ELECTRONIC BALLAST CIRCUIT FOR INDEPENDENTLY INCREASING THE POWER FACTOR AND DECREASING THE CREST FACTOR

[75] Inventor: Antonio Canova, Montevarchi, Italy

[73] Assignee: MagneTek, Inc., Nashville, Tenn.

[21] Appl. No.: 08/892,875

[22] Filed: Jul. 15, 1997

[51] Int. Cl.[6] ..... H05B 37/02

[52] U.S. Cl. ..... 315/247; 315/224; 315/209 R; 315/244

[58] Field of Search ..... 315/247, 209 R, 315/224, 244, 307

[56] References Cited

U.S. PATENT DOCUMENTS

| | | | |
|---|---|---|---|
| 5,426,344 | 6/1995 | Wong et al. | 315/200 |
| 5,500,576 | 3/1996 | Russell et al. | 315/209 R |
| 5,517,086 | 5/1996 | El-Hamamsy et al. | 315/247 |
| 5,521,467 | 5/1996 | Statnic et al. | 315/DIG. 7 |
| 5,557,176 | 9/1996 | O'Brien | 315/209 R |
| 5,565,743 | 10/1996 | Yamashita et al. | 315/DIG. 7 |
| 5,610,474 | 3/1997 | Schmitt | 315/209 R |

FOREIGN PATENT DOCUMENTS

| | | |
|---|---|---|
| 0 311 424 A2 | 8/1989 | European Pat. Off. . |
| 0 488 478 A2 | 6/1992 | European Pat. Off. . |
| 0 621 743 A1 | 10/1994 | European Pat. Off. . |
| 0 627 871 A1 | 12/1994 | European Pat. Off. . |
| 0 667 734 A1 | 8/1995 | European Pat. Off. . |
| 0 697 803 A2 | 2/1996 | European Pat. Off. . |
| 2 261 779 | 5/1993 | United Kingdom . |
| 2124042 | 2/1994 | United Kingdom . |

*Primary Examiner*—Michael B. Shingleton
*Attorney, Agent, or Firm*—Waddey & Patterson; Mark J. Patterson

[57] ABSTRACT

The device provides a power-supply section (3) connected to an AC source (21) and an inverter section (5) for supplying power to an electrical load (9, 11) through an oscillating circuit (13, 15). Two capacitors, a filter and a smoothing capacitor (27, 29) are arranged between a rectifier bridge (25) and the controlled cutouts (33, 35) of the inverter. The power-supply section (3) has an inductor (39) with a value such that the power-supply section (3) exhibits a predominantly inductive behaviour towards the inverter section (5).

20 Claims, 8 Drawing Sheets

ELECTRONIC BALLAST CIRCUIT FOR INDEPENDENTLY INCREASING THE POWER FACTOR AND DECREASING THE CREST FACTOR

FIELD OF THE INVENTION

The present invention relates to an inverter device for the power supply of an electrical load, in particular of a discharge lamp.

PRIOR ART

Devices of this type are described for example in GB-A-2,124,042, EP-A-0 667 734, EP-A-0 488 478, U.S. Pat. No. 5,426,344.

These devices have a rectifier powered by an AC source, for example the standard electrical mains. In parallel with the rectifier bridge (see for example GB-A-2,124,042) there is provided a filter capacitor and a smoothing capacitor for supplying a substantially DC voltage to an inverter circuit section, comprising controlled switching means for powering a load with an oscillating circuit at a high-frequency voltage. A diode is interposed between the rectifier bridge and the filter capacitor on the one hand and the smoothing or "bulk" capacitor on the other.

Circuits of this type must exhibit a high power factor as close as possible to one and a limited crest factor. Power factor is understood to mean the ratio of active power to apparent power, while crest factor is understood to mean the ratio of the maximum value of the current in the load to its root-mean-square value and measures the amount of fluctuation, at a frequency typically double the frequency of the AC supply, of the peak value of the current at the load. In inverters for the power supply of discharge lamps the oscillation in the peak value of the load current is detrimental since it reduces the lifetime of the lamp.

The object of the present invention is the production of an inverter device which makes it possible to alleviate the drawbacks of conventional devices.

In particular, the object of the invention is to produce an inverter circuit of the type mentioned above which exhibits a greater power factor than conventional circuits.

A further object of an improved embodiment of the invention is the production of a circuit with a reduced crest factor, and in particular a circuit in which it is possible to increase the power factor and reduce the crest factor independently of one another.

SUMMARY OF THE INVENTION

These and further objects and advantages, which will become clear to those skilled in the art from reading the following text, are achieved with an inverter circuit of the type mentioned above, in which, in the power-supply section, in series with the rectifier bridge supplied by the AC voltage source, there is arranged an power supply inductor with a value such that the said power-supply section exhibits a predominantly inductive behaviour towards the load. The predominantly inductive behaviour thus achieved causes the inverter and the load powered by it to see a source of current instead of a source of voltage, as in conventional circuits, with a consequent improvement in the power factor of the device.

The power supply inductor indicated above can be arranged upstream or downstream of the rectifier bridge.

An auxiliary capacitor which resonates with the said power supply inductor when the voltage across the terminals of the rectifier bridge passes through the zero value can advantageously be arranged between the power supply inductor and the inverter (consisting for example of a half-bridge structure with two high-frequency controlled cutouts) This makes it possible, as will clearly be seen below with reference to an illustrative implementation of the invention, to reduce the crest factor independently of the power factor.

Upstream of the rectifier bridge, between it and the AC voltage source, there is also advantageously provided, in a manner known per se, an EMI filter (electromagnetic interference filter) against conducted noise, with a cutoff frequency typically greater than 10 kHz.

Further advantageous characteristics and implementations of the invention are indicated in the attached dependent claims.

BRIEF DESCRIPTION OF THE DRAWINGS

The invention will be better understood by following the description and appended drawing, which shows a practical non-limiting exemplification of the invention. In the drawing.

DETAILED DESCRIPTION OF THE INVENTION

Figure 1:
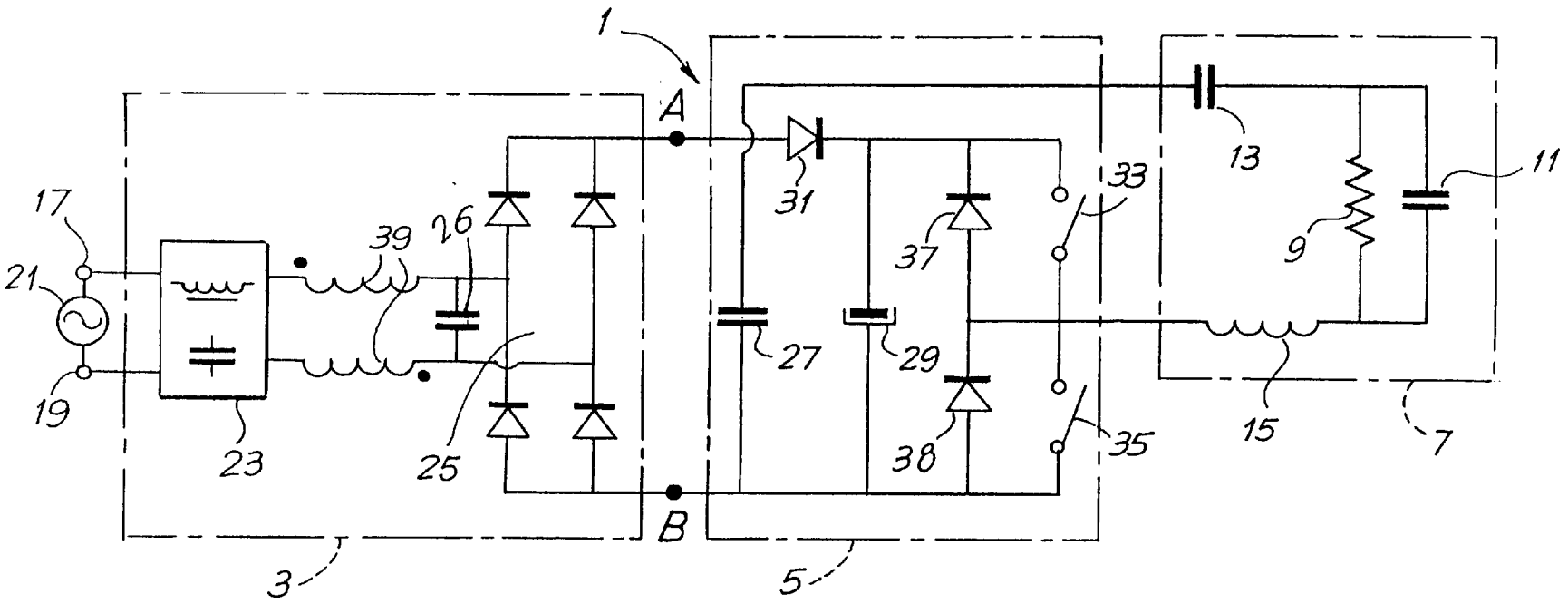
FIG. 1 shows a schematic of a circuit according to the invention, in a first implementation.

FIG. 1 shows a first implementation of the device according to the invention. The circuit, indicated generally as 1, has a first power-supply section indicated overall as 3 and an inverter section 5 to which is connected a load 7, in the example a discharge lamp represented by a resistor 9 whose electrodes are connected together by a capacitor 11. Indicated as 13 and 15 are a capacitor and an inductor defining a resonant circuit connecting the load to the inverter section 5.

The power-supply section has two terminals 17, 19 for connection to an external AC voltage source 21, for example the standard 50 Hz, 220 V (or 60 Hz, 110 V) electrical mains. An EMI filter 23 with an inductor component, of a type known per se, is interposed between the mains power and the circuit. The AC voltage from the mains is rectified by a rectifier bridge 25, in which the two output poles connected to the inverter section 5 are indicated as A and B. In parallel with the rectifier bridge 25 is arranged a filter capacitor 27, and a second capacitor 29, indicated hereafter as a bulk or smoothing capacitor, is connected in parallel with the rectifier bridge 25 with the interposition of a unidirectional component represented by a diode 31 between the positive pole of the rectifier bridge 25 and a terminal of the bulk capacitor 29. The bulk capacitor 29 supplies a substantially constant voltage to the inverter section 5. The ratio of the capacitances of the capacitors 29 and 27 is of the order of 100:1 to 10,000:1 and typically around 1000:1. The capacitor 27 can be arranged upstream of the rectifier bridge 25 and/or combined with a further capacitor 26 upstream of the bridge.

The inverter 5 has, furthermore, switching means represented by a half-bridge arrangement schematized by two controlled cutouts (typically two transistors) indicated as 33 and 35 in parallel with respective diodes 37 and 38. The half-bridge is controlled in a manner known per se via a circuit (not shown) for supplying the load 7 with a voltage at high frequency, typically of the order of a few tens of kHz.

Arranged in series with the rectifier bridge 25 is an power supply inductor 39 which, in the example of FIG. 1, is subdivided into two windings arranged respectively on the input arm and on the output arm of the rectifier bridge 25, between the latter and the filter 23. The value of this power supply inductor 39 is such that the power-supply section 3 is seen by the inverter section 5 as a predominantly inductive source, i.e. basically, virtually a source of current rather than, as in conventional circuits, a source of voltage. The value of the power supply inductor 39 is therefore markedly different from the value of the inductive component normally provided in the filter 23.

The behaviour of the circuit of FIG. 1 in its various operating phases will now be described with reference to FIGS. 2 to 6, which show the circuit elements active in each phase. The current flowing in the circuit will be indicated as follows: $I_L$ indicates the current in the load 7, and $I_i$ indicates the current input to the inverter section 5, i.e. the current at the terminals A and B of the rectifier bridge 25; $I_{cr}$ indicates the current at the filter capacitor 27. The directions of the currents are indicated in the various figures. Furthermore, $V_{cr}$ indicates the voltage across the filter capacitor 27 and $V_b$ the voltage across the smoothing or bulk capacitor 29.

Figure 2:
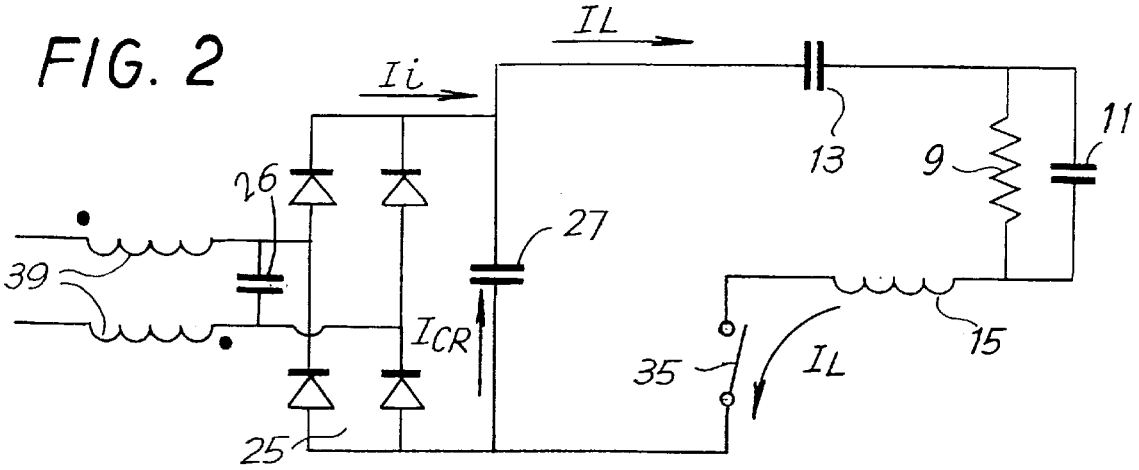
FIGS. 2 to 6 show the five successive phases of operation of the circuit of FIG. 1.

The first operating phase is illustrated in FIG. 2: the cutout 33 is open and the cutout 35 is closed. The load current at the initial instant ($I_L(0)$) is zero. During this phase the current $I_{cr}$ which flows through the capacitor 27 is given by the difference between the load current $I_L$ and the input current $I_i$. The capacitor 27 discharges ($V_{cr}$ decreases) if $I_L$-$I_i$ is positive, whereas it charges if the opposite is true. In this phase both conditions may occur.

This first phase ceases when the circuit for controlling the switching means opens the controllable cutout 35.

Figure 3:
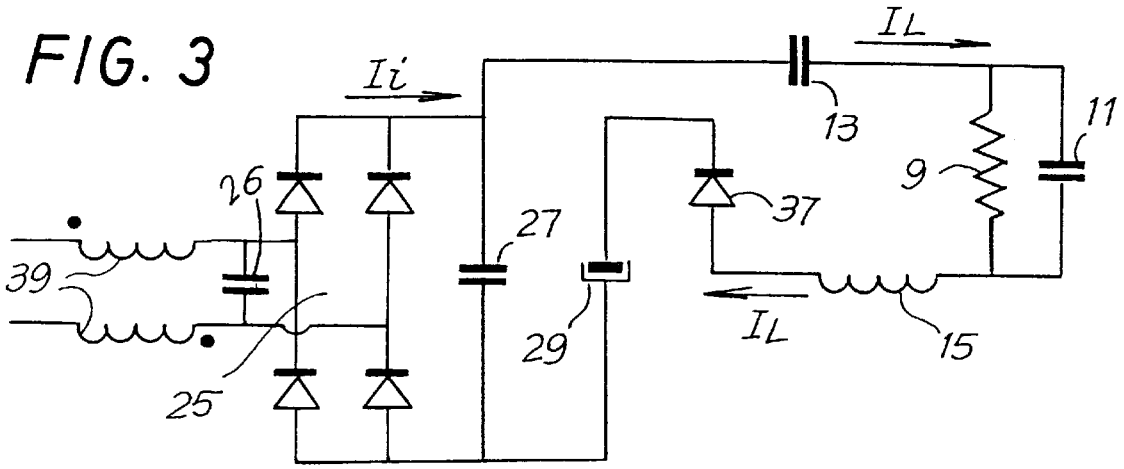

In the second phase, illustrated in FIG. 3, both cutouts 33, 35 are open. The load current $I_L$ flows in the same direction as the previous phase, since the circuit is functioning above the resonant frequency. The current $I_L$ flows through the diode 37 and the bulk capacitor 29. The load circuit 7 transfers energy to the bulk capacitor 29.

This second phase ceases when the value of the load current $I_L$ passes through zero and reverses its direction.

Figure 4:
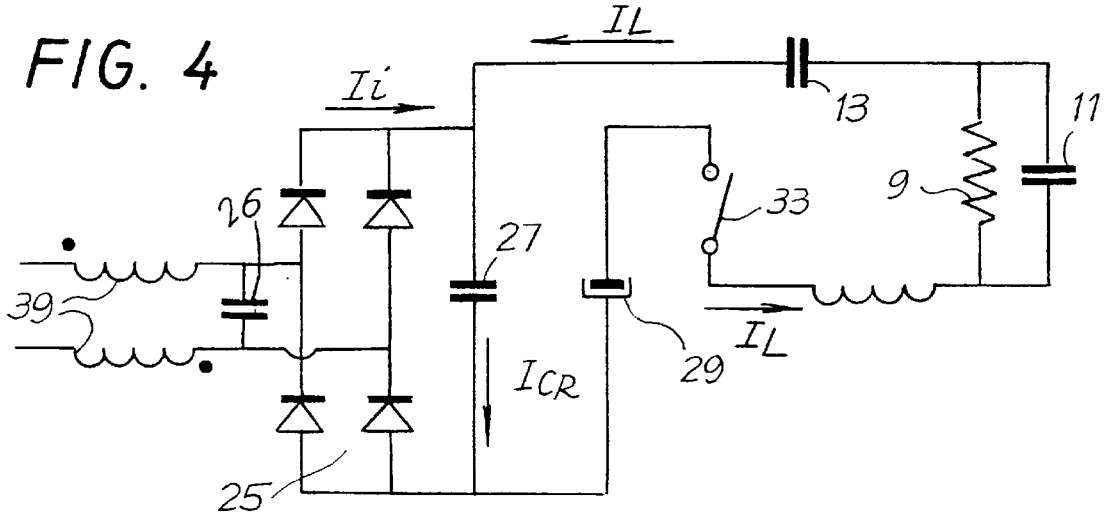

The third phase is represented by the schematic of FIG. 4: the cutout 33 is closed while the cutout 35 is open. The load current at the initial instant ($I_L(0)$ ) is zero. The bulk capacitor 29 delivers energy to the resonant load circuit 7, while the capacitor 27 is charged with a current $I_{cr}=I_i-I_L$ which flows in the direction indicated in the schematic. The voltage across the capacitor 27 increases until it reaches the value of the voltage of the bulk capacitor 29. At this instant the diode 31 becomes conducting and the fourth phase of the operating cycle of the circuit begins.

Figure 5:
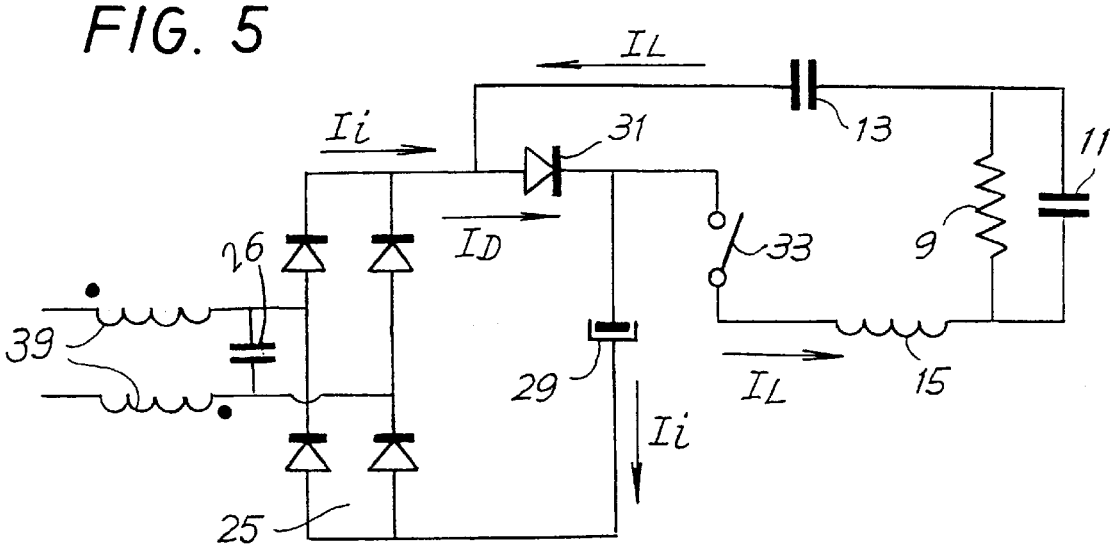

The fourth phase is illustrated in FIG. 5. The diode 31 is conducting, the cutout 33 is closed while the cutout 35 is open. The voltages across the capacitors 27 and 29 are equal. The load current $I_L$ flows through the diode 31 and the cutout 33, while the input current $I_i$ flows through the diode 31 into the bulk capacitor 29 and charges it. The fourth phase ends and the fifth and last phase begins when the control circuit opens the cutout 33.

Figure 6:
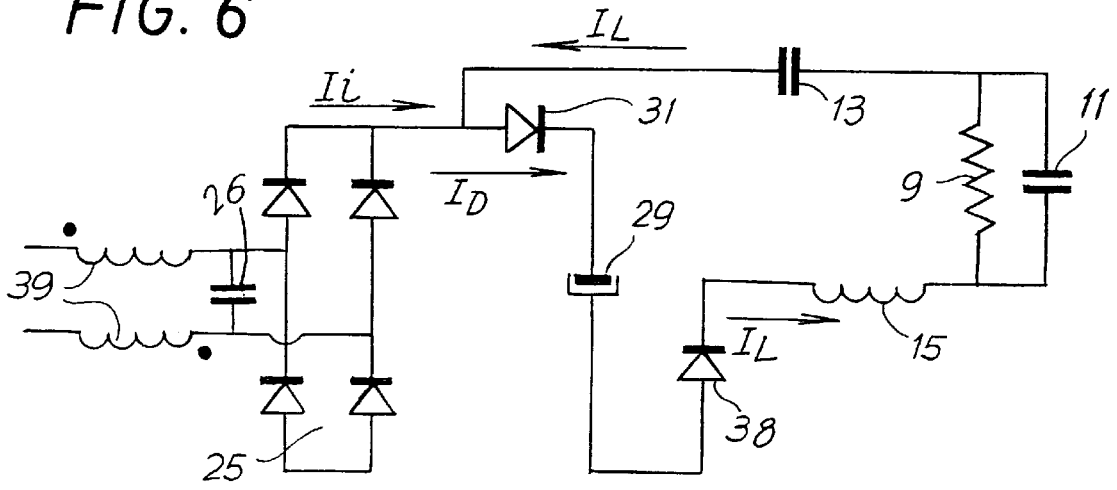

The fifth phase is shown in the schematic of FIG. 6. Both the cutouts 33 and 35 are open, while the diode 38 is conducting. The current $I_D$ which flows into the bulk capacitor 29 is given by the sum of the load current $I_L$ and the input current $I_i$. This phase ceases when the control circuit closes the cutout 33 so as to recommence the first phase.

Figure 7:
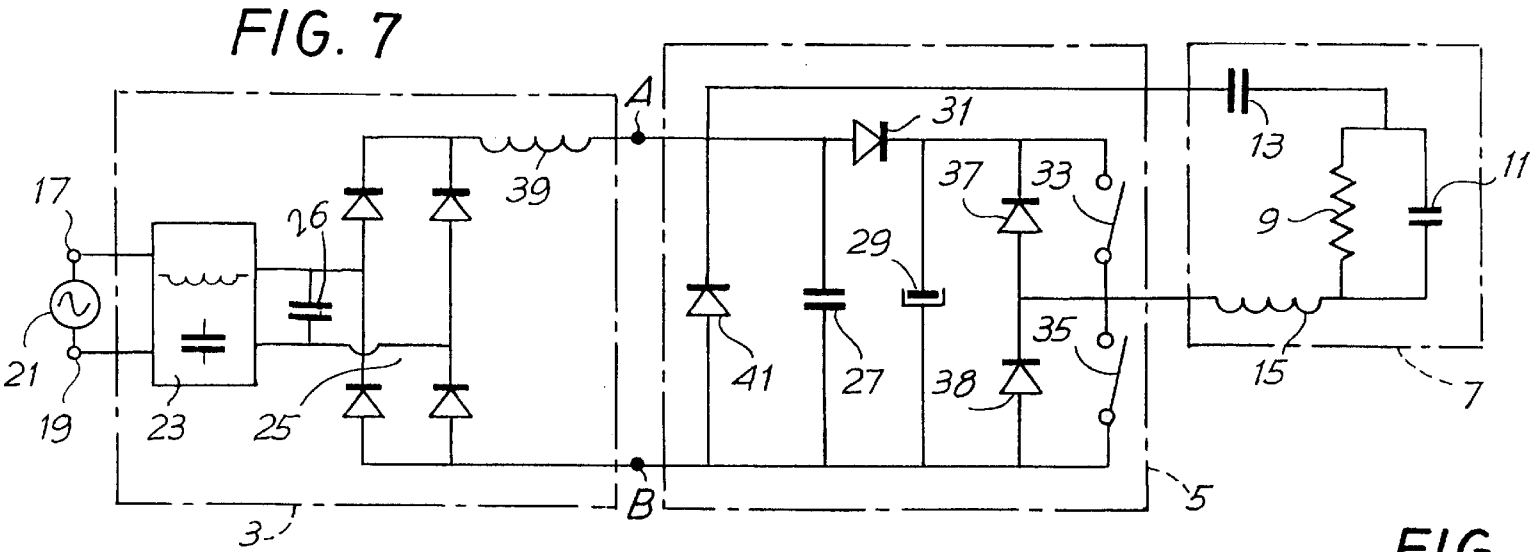
FIG. 7 shows a modified implementation of the device according to the invention.

The same succession of phases takes place in a circuit in which the power supply inductor 39 in series with the rectifier bridge 25 is arranged between the latter and the inverter section 5, rather than between the rectifier bridge 25 and the input filter 23. Such a configuration is shown in FIG. 7 where identical numerals are used to indicate parts in this circuit which are identical to or correspond with those of FIG. 1. By comparison with the previous solution, a unidirectional element, represented by the diode 41, is provided in parallel with the filter capacitor 27 in order to avoid inversion of the polarization of the latter.

Figure 9:
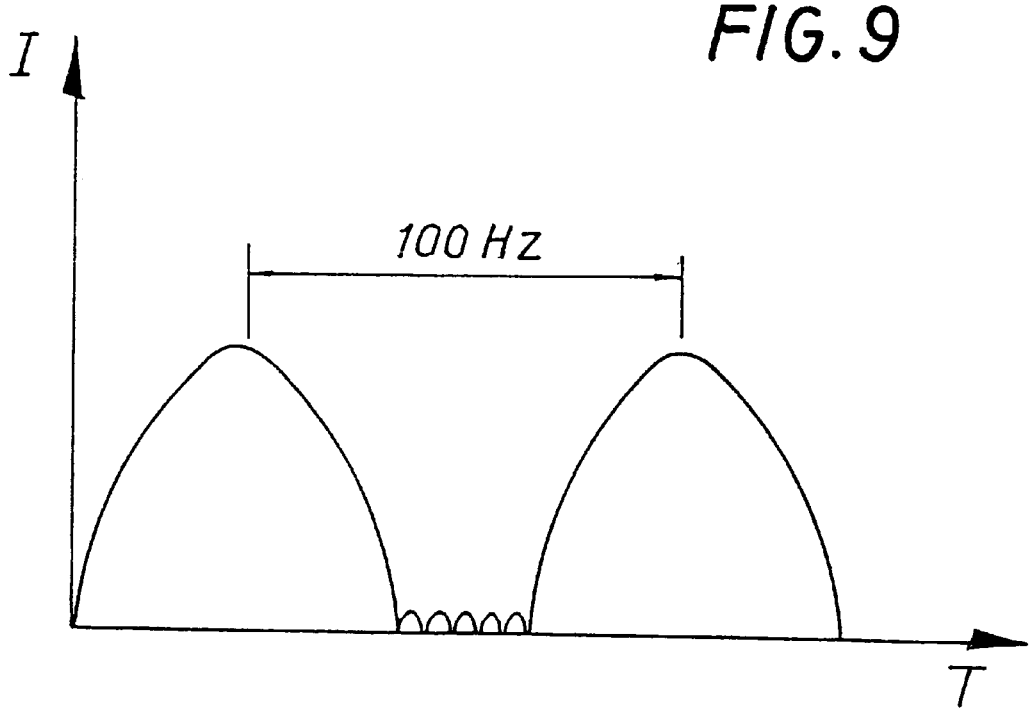
FIGS. 9 and 10 show two diagrams indicating the profile of the current in the power supply inductor in series with the rectifier bridge in the implementation of FIG. 7.
Figure 10:
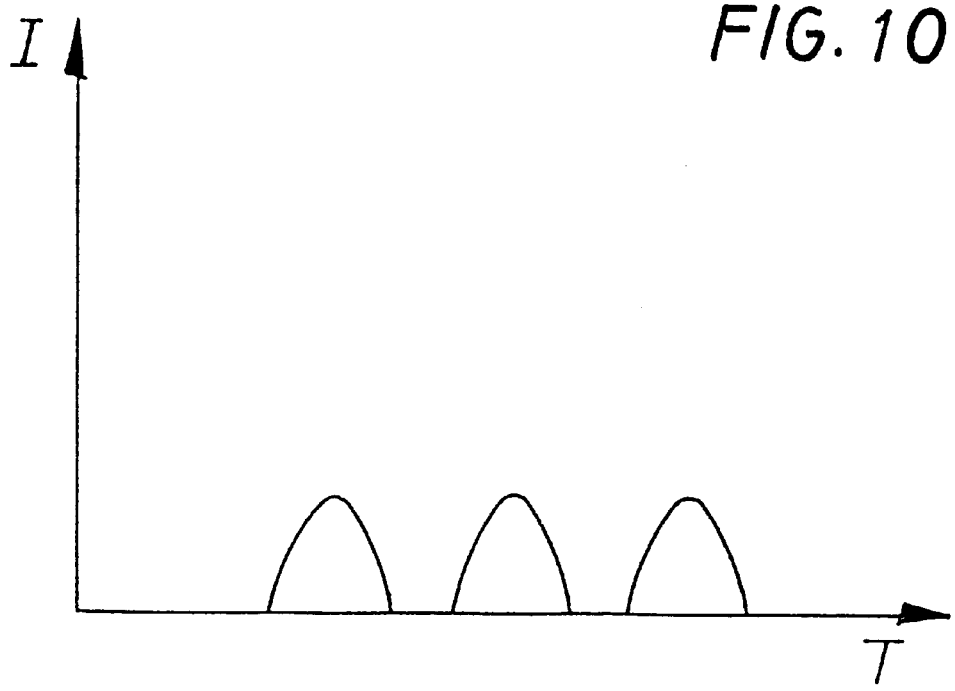

In the circuit now described the current in the power supply inductor 39 versus time has the profile indicated qualitatively in FIGS. 9 and 10, where the diagram of FIG. 10 is an enlargement of the intermediate region of oscillation between the two half-waves indicated in the diagram of FIG. 9. It will be observed from the diagrams of FIGS. 9 and 10 that, as the mains voltage passes through zero, the current in the power supply inductor 39 undergoes a discontinuous profile oscillating at a frequency equal to the switching frequency of the inverter 5. This happens because as the mains voltage passes through zero, the energy accumulated in the power supply inductor 39 is low and is transferred to the bulk capacitor 29 before the end of a switching period. The current $I_L$ in the load circuit 7 reaches a peak precisely as the mains voltage passes through zero. This happens because in these time intervals the filter capacitor 27 is charged and discharged by the load current $I_L$ alone and hence is, for almost the whole of the switching period, in series with the capacitor 13. The overall capacitance of the series arrangement of the capacitors 27 and 13 is approximately equal to the capacitance of the capacitor 27 alone, whose value is much less than the value of the capacitor 13. This brings about a rise in the resonant frequency of the LC resonant circuit which powers the load 7, the circuit consisting of the elements 13, 27 and 15. As the resonant frequency rises and approaches the switching frequency, it brings about an increase in the current in the load 7 and hence an increase in the crest factor. The greater the value of the impedance of the power supply inductor 39, the greater this increase. Hence, if on the one hand the power factor of the circuit is improved by a high value of the impedance of the power supply inductor 39, then on the other hand this brings about a deterioration in the crest factor. Therefore, choosing the value of the impedance of the power supply inductor 39 becomes a matter of compromise between the two effects.

Figure 8:
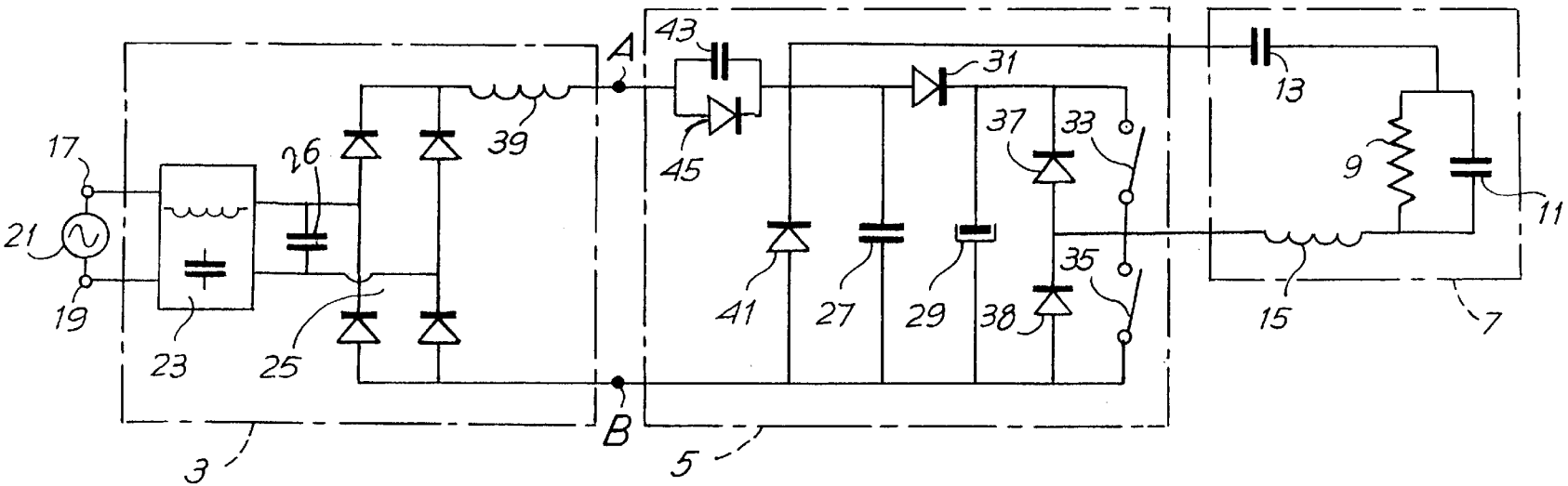
FIG. 8 shows an improvement of the device according to the invention with an auxiliary resonant capacitor.

The improved configuration of the circuit of FIG. 8 makes it possible to overcome this limitation since the addition of an auxiliary capacitor 43 (with a corresponding diode 45 which prevents the inversion of its polarization) in series with the impedance of the power supply inductor 39 uncouples the two phenomena, as will become clear from what follows.

In the circuit of FIG. 8 (in which elements identical to or corresponding with those of the circuits of FIGS. 1 and 7 are indicated with the same reference numerals) the capacitor 43 constitutes, together with the power supply inductor 39, an auxiliary resonant circuit. When the mains voltage, i.e. the voltage across the rectifier bridge 25, passes through zero, the capacitor 43 resonates with the power supply inductor 39 and diverts current from the filter capacitor 27. This entails a lowering of the resonant frequency of the circuit containing the capacitive components 27, 29, 43 and the inductive components 15 and 39 and hence a lowering of the current peak on the load 7 and a reduction in the crest factor.

In short, the capacitor 43 functions only within the time interval around the point at which the voltage across the rectifier bridge 25 passes through zero and its effect, in combination with the power supply inductor 39, is to reduce the resonant frequency and hence to limit the crest factor.

Figure 11:
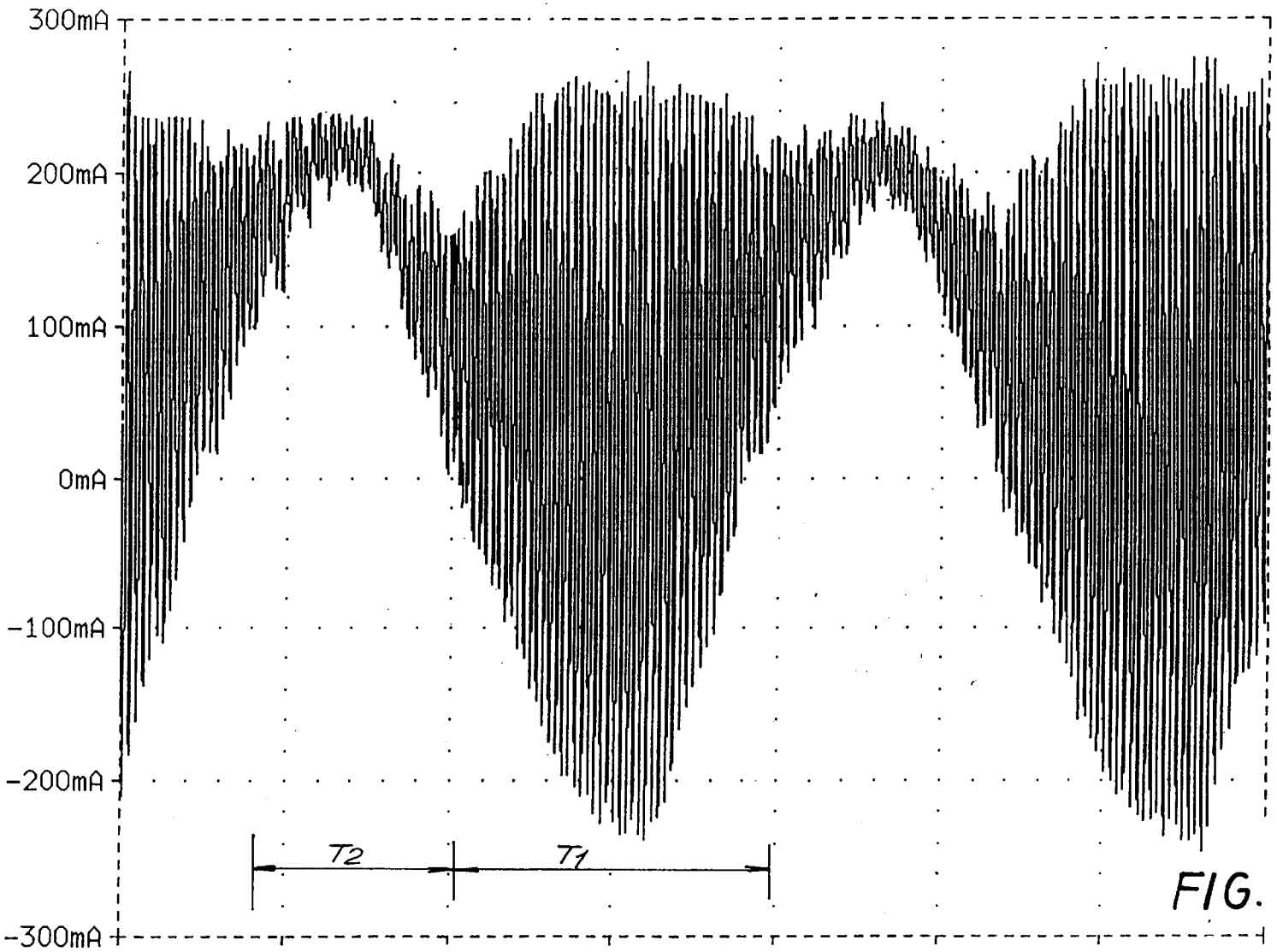
FIGS. 11, 12 and 13 show three diagrams with the profile of the current in the power supply inductor, of the voltage across the terminals of the rectifier bridge and of the current in the auxiliary resonant capacitor, these being obtained in a simulation of the circuit of FIG. 8.
Figure 12:
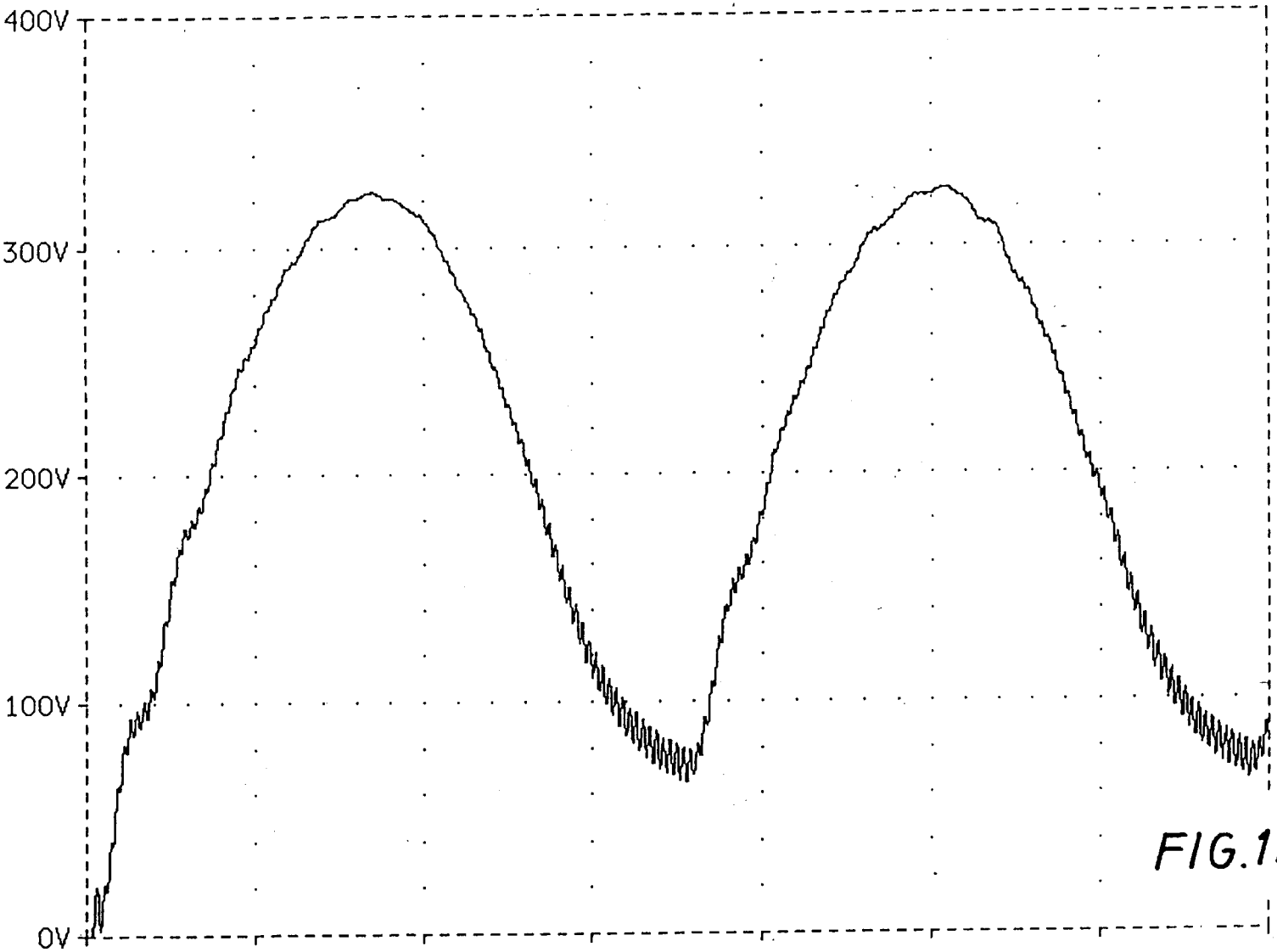
Figure 13:
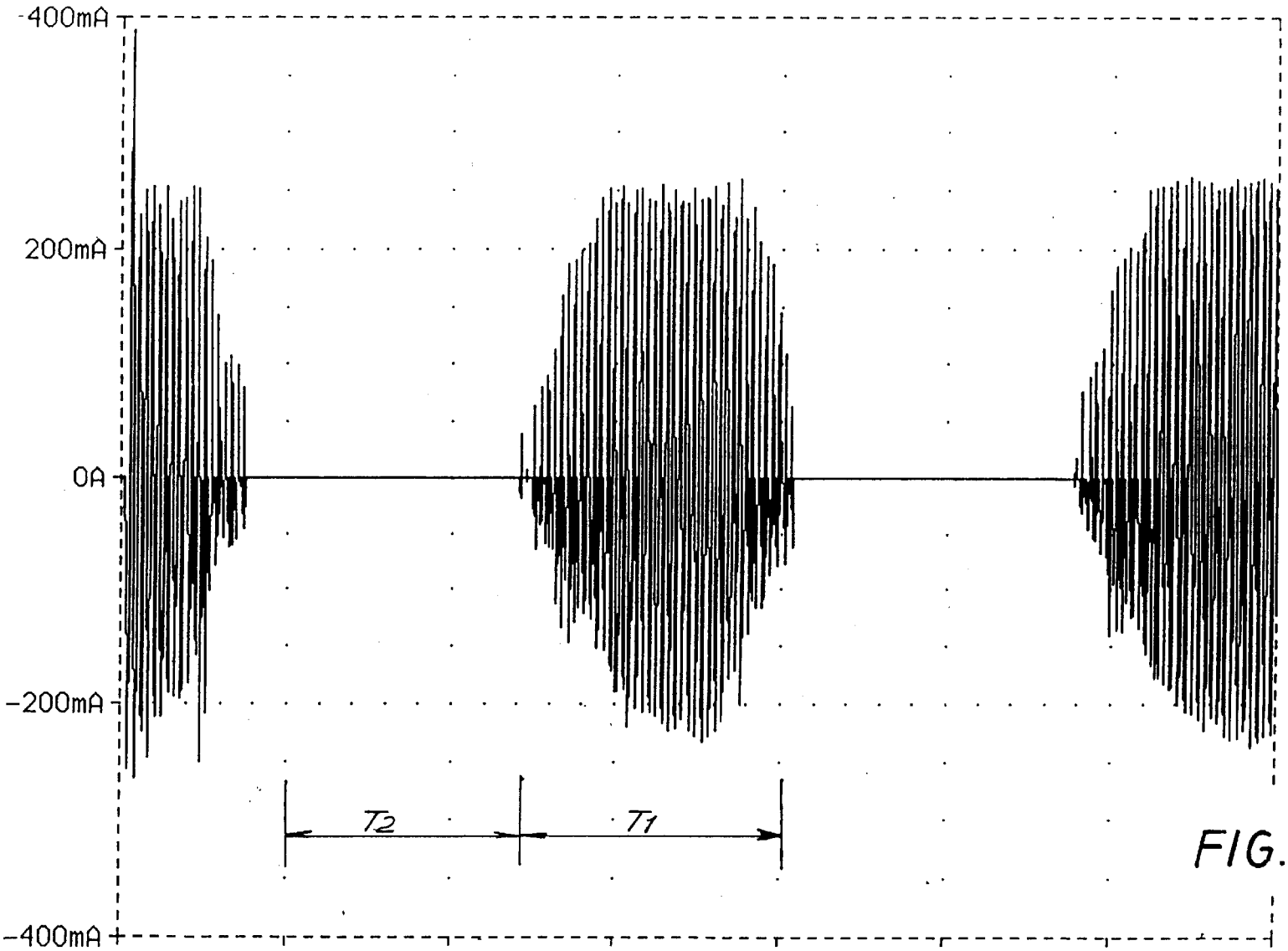

What is described above qualitatively can be appreciated quantitatively from the graphs of FIGS. 11 to 13. FIG. 11 shows a diagram which plots the time as abscissa and the value of the current in the power supply inductor 39 as ordinate. T1 indicates the time interval in which the capacitor 43 resonates with the power supply inductor 39. It is readily observed that in the said time interval the current in the inductor 39 oscillates between relatively high extreme values, while in the absence of the capacitor 43 the value of the current would be almost equal to zero.

Plotted in FIG. 12 is the profile of the voltage across the rectifier bridge 25 versus time within the same time interval as shown in FIG. 11: it will be observed that the trajectories of the two graphs are in phase. Finally, FIG. 13 shows the profile of the current in the auxiliary capacitor 43. This current is zero for a time interval T2, while it oscillates between finite values in the time interval T1.

It is understood that the drawing shows merely an example given solely by way of practical demonstration of the invention, it being possible for this invention to vary in its forms and arrangements without thereby departing from the scope of the concept underlying the said invention. Any reference numerals present in the attached claims have the purpose of facilitating the reading of the claims with reference to the description and to the drawing, and do not limit the scope of protection represented by the claims.

I claim:

1. An electronic ballast for the supply of power to a load comprising:

a power supply section connected to an AC voltage source, the power supply section including a rectifier bridge;

an inverter section connected to the power supply section;

a resonant circuit connected between the inverter section and the load, the inverter section providing a high frequency voltage to the load through the resonant circuit; and the power supply section further including a power supply inductor connected to the rectifier bridge, the power supply inductor having a value such that the power supply section exhibits a predominantly inductive behavior towards the inverter section so that the power supply section is sensed as a source of current by the inverter section.

2. The electronic ballast of claim 1, wherein the inverter section further comprises a pair of transistors.

3. The electronic ballast of claim 2, wherein the inverter section further comprises a filter capacitor.

4. The electronic ballast of claim 3, wherein the inverter section further comprises a smoothing capacitor.

5. The electronic ballast of claim 4, wherein the inverter section further comprises a unidirectional component connected between the filter capacitor and smoothing capacitor, the filter and smoothing capacitors supplying a substantially continuous current to the pair of transistors.

6. The electronic ballast of claim 1, wherein the power supply section further comprises an electromagnetic interference filter, the electromagnetic interference filter being connected between the AC voltage source and the rectifier bridge.

7. The electronic ballast of claim 1 wherein the power supply inductor is connected between the rectifier bridge and the inverter section.

8. The electronic ballast of claim 1 further comprising a diode, the diode being connected in parallel with the filter capacitor.

9. The electronic ballast of claim 1 further comprising an auxiliary capacitor, the auxiliary capacitor located in the inverter section and connected to the power supply inductor, wherein the power supply inductor and auxiliary capacitor resonate when the voltage across the terminals of the rectifier bridge passes through a zero value.

10. The electronic ballast of claim 9 further comprising a diode, the diode being connected in parallel with the auxiliary capacitor.

11. The electronic ballast of claim 1, wherein the transistors comprise a half-bridge structure with the transistors being alternately switched on and off and the load being connected between the center of the half-bridge structure and one end of the filter capacitor.

12. An electronic ballast for the supply of power to a load comprising:

a power supply section connected to an AC voltage source, the power supply section including a rectifier bridge;

an inverter section connected to the power supply section;

a resonant circuit connected between the inverter section and the load, the inverter section providing a high frequency voltage to the load through the resonant circuit; and an auxiliary capacitor in the inverter section, the auxiliary capacitor being connected to the power supply inductor, wherein the power supply inductor and auxiliary capacitor resonate when the voltage across the terminals of the rectifier bridge passes through a zero value;

the power supply section further including a power supply inductor connected to the rectifier bridge, the power supply inductor having a value such that the power supply section exhibits a predominantly inductive behavior towards the inverter section so that the power supply section is sensed as a source of current by the inverter section.

13. The electronic ballast of claim 12, wherein the inverter section further comprises a pair of transistors.

14. The electronic ballast of claim 13, wherein the inverter section further comprises a filter capacitor.

15. The electronic ballast of claim 14, wherein the inverter section further comprises a smoothing capacitor.

16. The electronic ballast of claim 15, wherein the inverter section further comprises a diode connected between the filter capacitor and smoothing capacitor, the filter and smoothing capacitors supplying a substantially continuous current to the pair of transistors.

17. The electronic ballast of claim 12, wherein the power supply section further comprises an electromagnetic interference filter, the electromagnetic interference filter being connected between the AC voltage source and the rectifier bridge.

18. The electronic ballast of claim 17 further comprising a diode, the diode being connected in parallel with the filter capacitor.

19. The electronic ballast of claim 12 further comprising a diode, the diode being connected in parallel with the auxiliary capacitor.

20. The electronic ballast of claim 12, wherein the transistors comprise a half-bridge structure with the transistors being alternately switched on and off and the load being connected between the center of the half-bridge structure and one end of the filter capacitor.

* * * * *